US006326902B1

(12) United States Patent
Tyburski

(10) Patent No.: US 6,326,902 B1
(45) Date of Patent: Dec. 4, 2001

(54) RESIDUAL CHARGE-EFFECT TRAFFIC SENSOR

(75) Inventor: Robert Tyburski, Lottsburg, VA (US)

(73) Assignee: Traffic Monitoring Services, Inc., Lottsburg, VA (US)

( * ) Notice: Subject to any disclaimer, the term of this patent is extended or adjusted under 35 U.S.C. 154(b) by 0 days.

(21) Appl. No.: 09/653,956

(22) Filed: Sep. 1, 2000

(51) Int. Cl.[7] ..... G08G 1/01

(52) U.S. Cl. ..... 340/933; 340/937; 340/941; 340/943; 200/86 A; 348/148

(58) Field of Search ..... 340/933, 941, 340/934, 935, 936, 937, 939, 940, 943; 200/86 A, 86 R; 348/148, 149; 701/117

(56) References Cited

U.S. PATENT DOCUMENTS

| | | | | |
|---|---|---|---|---|
| 4,258,430 | | 3/1981 | Tyburski | 364/900 |
| 5,448,232 | | 9/1995 | Tyburski | 340/933 |
| 5,450,077 | | 9/1995 | Tyburski | 340/933 |
| 5,463,385 | | 10/1995 | Tyburski | 340/933 |
| 5,710,558 | * | 1/1998 | Gibson | 340/933 |
| 5,808,562 | * | 9/1998 | Bailleul et al. | 340/933 |
| 5,835,027 | | 11/1998 | Tyburski et al. | 340/933 |
| 6,072,130 | * | 1/2000 | Burgess | 200/86 R |
| 6,130,627 | | 10/2000 | Tyburski et al. | 340/933 |
| 6,137,424 | * | 10/2000 | Cohen et al. | 340/933 |

* cited by examiner

*Primary Examiner*—Edward Lefkowitz
*Assistant Examiner*—Davetta W. Goins
(74) *Attorney, Agent, or Firm*—Jim Zegeer

(57) ABSTRACT

A vehicular roadway sensor comprising a conductive elastomeric housing having a sensor wire groove and one or more signal wire in the sensor wire groove, the sensor wire groove comprised of an airgap portion and a sensing wire portion for receiving and maintaining one or more insulated sensing wires in a fixed relation to establish a residual charge relationship with the conductive elastomeric housing so that when the fixed relationship is changed by the wheels of a vehicle on the housing a signal voltage is induced in the sensor, and one or more insulated signal carrying conductors connected to the one or more sensor wires, respectively. The one or more insulated signal carrying conductors are adhesively mounted in the conductive elastomeric housing so that vehicular traffic traversing the conductive elastomeric housing does not induce significant signals in the one or more insulated signal carrying conductors.

4 Claims, 7 Drawing Sheets

RESIDUAL CHARGE-EFFECT TRAFFIC SENSOR

REFERENCE TO PRIOR APPLICATION

Reference is made to application Ser. No. 09/144,102 entitled RESIDUAL CHARGE EFFECT TRAFFIC SENSOR filed Aug. 31, 1998 and U.S. Pat. No. 5,835,027 incorporated herein by reference.

BRIEF DESCRIPTION OF THE PRIOR ART

The invention relates to vehicle traffic sensing systems, and more particularly to vehicle traffic sensing systems using residual charge-effect sensing.

It has become apparent several improvements could be made by eliminating the conductive mounting bar disclosed in U.S. Pat. No. 5,835,027. The manufacturing cost could be significantly reduced, the data reliability could be increased to 100% and the field use could be more-user friendly. During the manufacturing process, the conductive mounting bar was hard to handle due to its weight. The automated equipment designed to fabricate these sensors was expensive and very large in size. Also, a complex design of rollers was required to open and close the conductive elastomeric material which totally encapsulated the conductive mounting bar and its associated components in order to make this assembly watertight. These procedures were workable, but they would have a negative impact on the sensor marketability. The sensor vehicle data output voltage signals were 100% accurate most of the time, but intermittently dropped to less than 100%. Four causes were identified for this condition:

(1) It was determined the adhesive bonding the signal wires to the conductive mounting bar were becoming detached and in effect these wires were turning into sensors due to their close proximity to the conductive elastomeric material.

(2) It was determined on hot dry days the rotating tires on the vehicles were generating and accumulating a static charge and sometimes this static charge would be released to the roadway sensor causing an unwanted signal to appear or negate a valid signal.

(3) Heavy trucks, e.g. large dump trucks carrying sand and loaded cement trucks, would generate unwanted signals due to the conductive elastomeric material collapsing onto the transmitting signal wires turning them into sensors.

(4) Due to capacitance coupling between the wires within the multi-conductor cable between the sensor and the data record, erroneous signals were being introduced to the data records input circuitry.

It was determined after repeated usage of the sensor at multiple different locations that the conductive mounting bar was distorting between the hold-down clamps within the traffic lanes. This distortion was in the form of a six to eight inch arc in the direction of the traffic flow. Although this distortion did not cause a noticeable operational loss in signal, it had an effect on the timing of signals from two sensors when the data record is calculating the speed of the vehicle. The physical change made it very time-consuming to recover the sensor from the roadway when it came time to secure the sensor onto a reel which has a fixed dimension of two inches. This arc was caused by the conductive mounting bar taking a set in the material and made it difficult to wind it on the reel for transport to the next installation. The only practical method of placing the sensor on the reel was to lay the sensor parallel to the roadway and straighten out the arc with the use of a hammer and a long piece of wood. This procedure would not meet the minimum safety standards set by Department of Transportation's in the USA.

The present invention was developed to overcome the aforementioned problems experienced during the manufacturing process and subsequent field testing. The roadway traffic sensor was simplified by removing the conductive mounting bar and several other novel methodology were employed to significantly improve the performance and reduce the manufacturing costs of this roadway traffic sensor.

Accordingly, a primary object of the present invention is to provide an improved portable traffic sensor which is relatively inexpensive to produce, is durable, very accurate, easily and safe to deploy. It will be used to monitor singular or multiple independent lanes of traffic simultaneously. A secondary object of this invention is to slightly vary the three basic components of the portable roadway sensor resulting in a permanent roadway sensor which can be installed within the surface of concrete or asphalt roadways.

It is a more specific object of the invention to provide a traffic sensor including an elastomeric extrusion containing one or more longitudinal grooves with one of its sides open to be subsequently closed using an adhesive backed tape. At least one sensing element or a parallel group of sensing elements per lane supported within the extrusion which generates signals when impacted by the tire of a vehicle. A signal transmission wire securely bonded within the groove of the elastomeric extrusion connected to the sensing element for transmitting these signals to a cable arrangement connected to analyzing equipment for evaluation, displaying and storing vehicle data generated by the sensing element.

The sensor is characterized by a first electrode or conductor, a first dielectric in intimate contact with the first electrode which carries a residual charge that migrates to the first electrode/first dielectric interface when placed in intimate contact therewith, a second dielectric arranged adjacent to the first dielectric, and a second electrode or conductor arranged adjacent to the second dielectric. The first electrode and dielectric may be, for example, an ordinary insulated electrical wire such as a wire coated with a synthetic resin polymer (Teflon™) and the second dielectric may be an air gap which surrounds some of the wire. Certain other materials such as paper exhibiting a residual charge may also be used as one of the dielectrics.

It is another object of this invention to minimize cross-talk between the transmitting signal wires within the elastomeric extrusion by taking advantage of the conductive properties of the elastomeric extrusion by nesting them in grooves.

It is another object of this invention to significantly improve the signal to noise ratio by securely bonding the transmitting signal wires to the base of the grooves within the elastomeric extrusion.

It is another object of this invention to eliminate the cross-talk between the wires of the transmission signal wire cable between the roadway sensor and the analyzing equipment with the use of a special purpose electronic amplifier circuit.

It is another object of this invention to eliminate vehicle generated static voltage discharge from appearing or negating valid sensor signals on the transmitting signal wires connected to the analyzing equipment with an earth ground connection to the elastomeric extrusion.

It is another object of this invention to significantly increase the signals energy by using parallel groups of ordinary insulated wire coated with a synthetic resin polymer.

It is another object of this invention to differentiate between lightweight and heavyweight vehicles and store a unique code representing this difference.

It is another object of this invention to reduced the manufacturing cost, weight and ease of deployment of the roadway traffic sensor by eliminating the conductive mounting bar.

It is another object of this invention to provide a traffic sensor having an access opening in the elastomeric extrusion thereby affording easy access to the component parts of the roadway traffic sensor.

It is another object of this invention to provide a traffic sensor that has a low profile and can be either mounted on the surface of the roadway or embedded within the roadway.

It is another object of this invention to provide a traffic sensor which operates in a non-directional mode.

It is a further object of the present invention to provide a traffic sensor which can be used with existing traffic analyzing equipment.

BRIEF DESCRIPTION OF THE DRAWINGS

The above and other objects, advantages and features of the invention will become more apparent when considered with the following specification and accompanying drawings wherein.

DETAILED DESCRIPTION OF THE INVENTION

Figure 1:
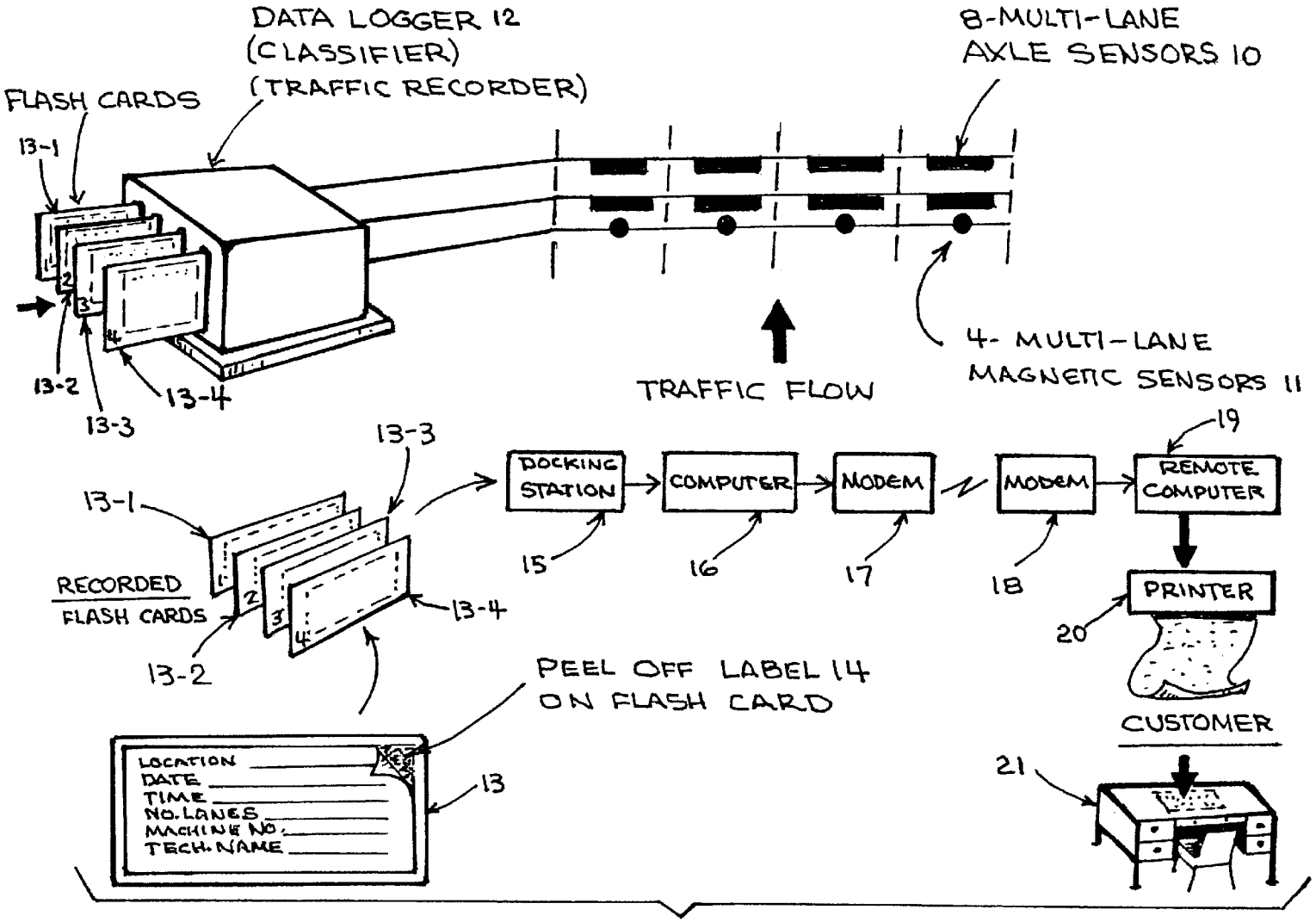
FIG. 1 is a functional block diagram of a multilane axle sensor incorporating the invention.

Referring to FIG. 1, an array of eight multilane axle sensors (two spaced rows) 10 is deployed on a four-lane highway with an array of magnetic sensors 11 which are coupled to data logger 12 which has removable digital data memory or storage devices, flash cards 13-1, 13-2, 13-3, 13-4, one for each lane of the roadway. It will be appreciated that instead of flash cards, other forms of digital data storage, such as memory "sticks", floppy disks, etc., can be used and the four channels or lanes of data can be multiplexed and stored on a single removable digital data storage device. Each flash card 13 carries a peel-off label 14 upon which data is entered, such as location, data, time, number of lanes, machine numbers, technician's name, etc.

At selected time intervals, the flash cards bearing the recorded traffic data are removed from data logger 12 and replaced with fresh flash cards, and the recorded data downloaded at a docking station 15 to computer 16 which transmits the data via modem 17 to a remote facility 18. The raw axle sensor data can be processed in computer 16 and/or remote computer 19 and printed in printer 20 for use by the customer 21.

Figure 2A:
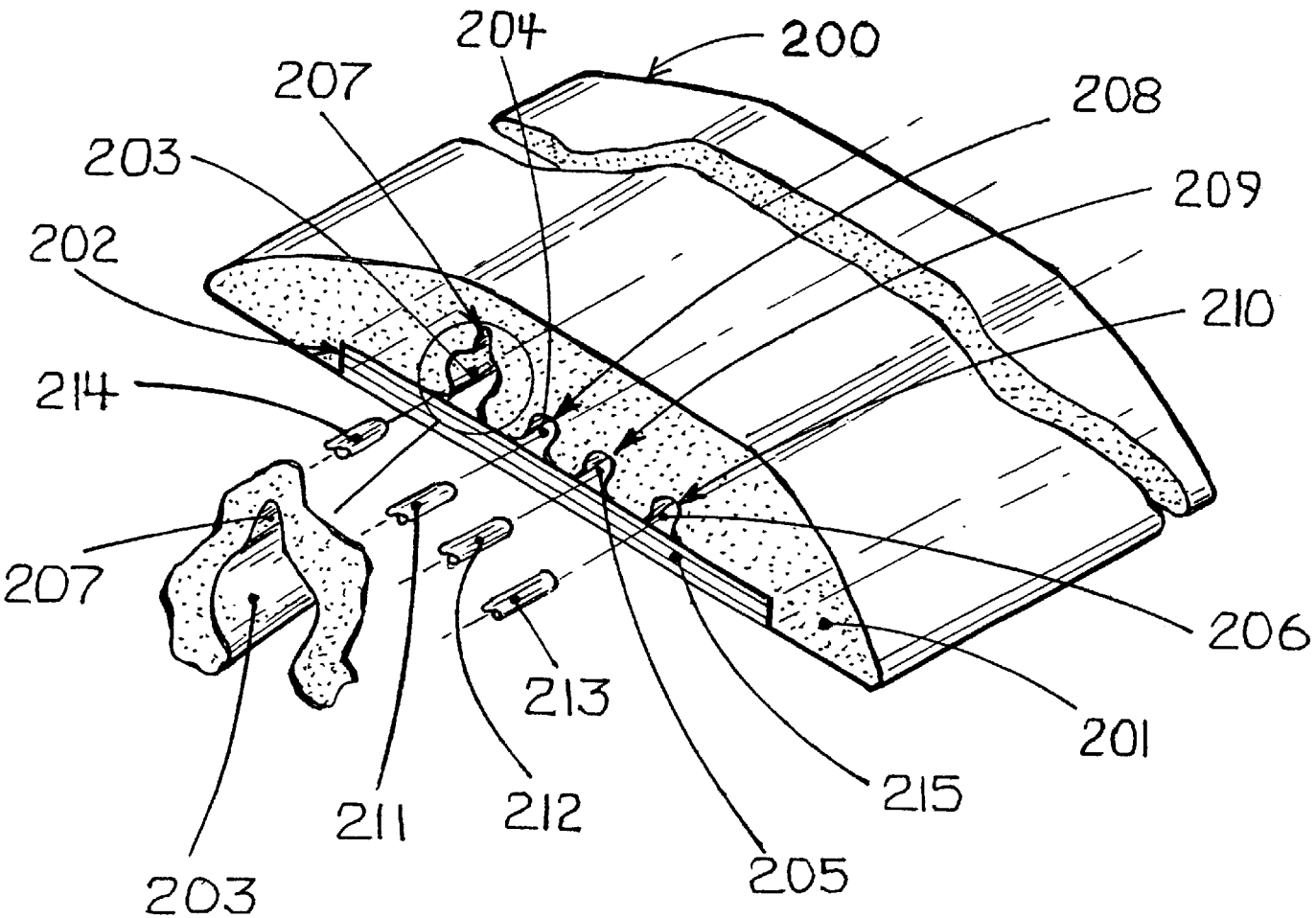
FIG. 2A illustrates a sensor for monitoring multiple lanes of traffic.
Figure 2B:
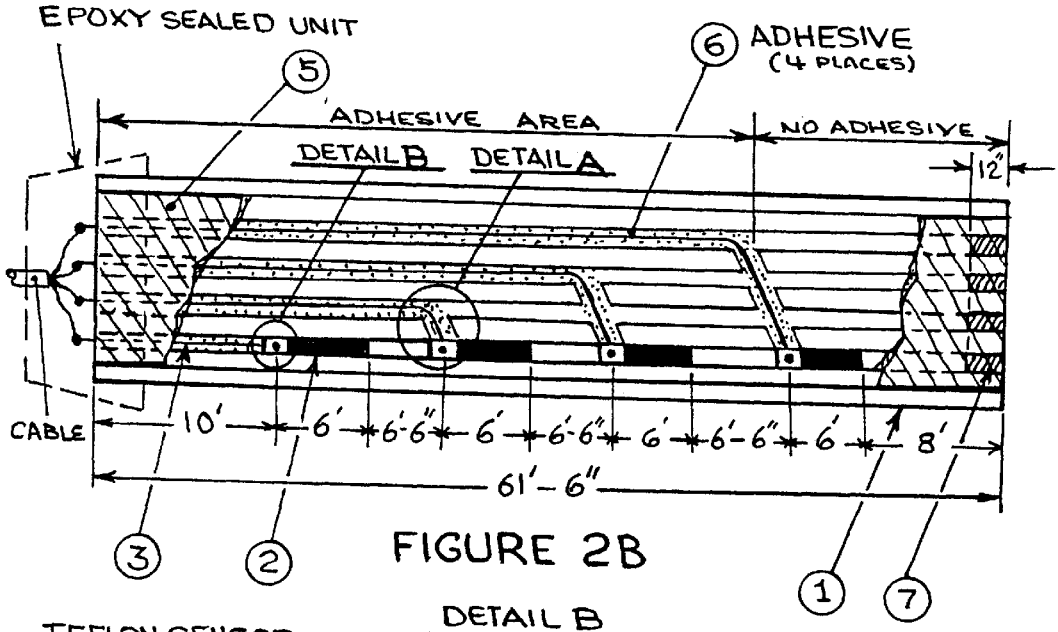
FIG. 2B is a bottom view of the conductive extrusion.
Figure 2D:
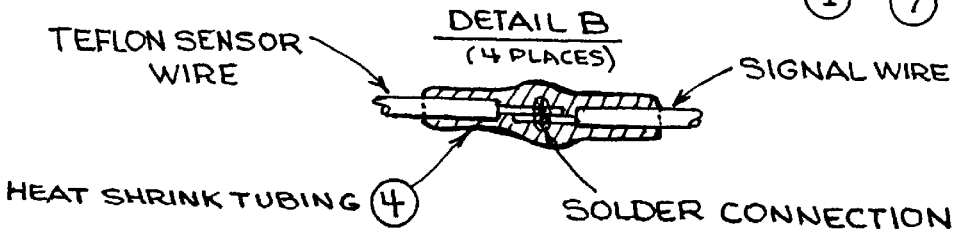
FIG. 2D is an enlargement of detail B.
Figure 2C:
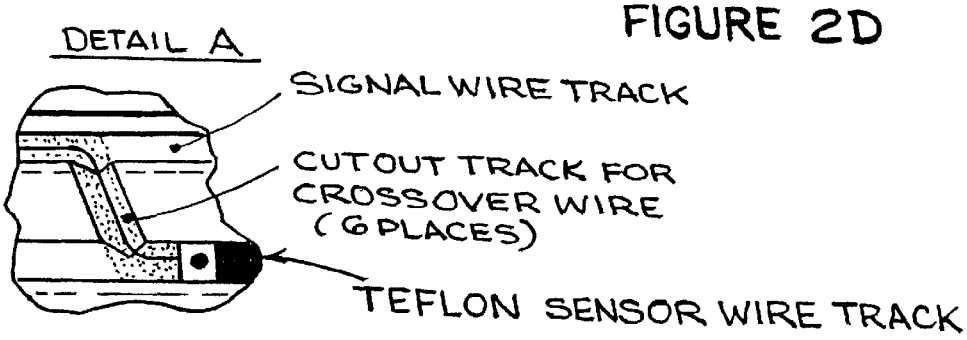
FIG. 2C is an enlargement of detail A.

A sensor for monitoring multiple lanes of traffic is shown in FIG. 2A. The sensor 200 includes an elongated housing 201 which is formed of, for example, a conductive elastomeric material and contains an elongated cavity 202 which is adapted for a matching piece of adhesive tape 215. Cavity 202 is open during the manufacturing process to allow the installation of sensor elements and transmitting signal wires. The housing 200 is formed of a conductive elastomeric material and is configured to lie on the roadway surface and is fixed thereto using appropriate hold-down devices (not shown). The housing protects the internal wiring of the traffic sensor from the ambient environment and also owing to its conductive property, acts as a movable electrode which in concert with other elements generates an electric signal when struck by the tire of a vehicle traversing the sensor.

Housing 201 contains five grooves, 203, 204, 205, 206 and 207. Groove 203 serves three functions. First, it is shaped to suspend all the independent lane sensor elements. Secondarily it is shaped to maintain an air gap 207 (second dielectric) between the sensors dielectric (first dielectric) and the conductive elastomeric material (second electrode). Thirdly to support a transmitting wire for one of the multilane configurations. Groove 203 has been extruded with adjoining groove 207 to create an air gap (second dielectric) when no tire is present. When the weighted tire of a vehicle traverses sensor 200 and makes contact on top of grooves 203 and 207, the air gap is distorted by the collapse of the conductive elastomeric material (second electrode) causing the residual charge within the sensor element (first electrode/first dielectric) to change resulting in the generation of electric signal on the sensors first electrode (conductor). A rubber-insulated transmitting wire electrically bonded to the sensors conductor on one end and on the other end via cables connected to the analyzing equipment.

A wide range of insulated coated wires could be used as a sensor element. It could be a wire with a solid conductor or a wire with a few or many stranded conductors. The dielectric coating on the wires conductor could be more different dielectric coatings available within industry. A special purpose sensor element could be fabricated by placing a thin piece of Teflon™ plumbers tape onto the conductive adhesive side of a length of copper tape. This combination would represent a first electrode/first dielectric sensor element. There are many combinations of first electrode/first dielectric configurations too numerous to mention in this improvement invention. By example, this invention uses a length of #16 gauge stranded wire coated with Teflon™ insulation as the sensor element 214.

Grooves 204, 205 and 206 are for signal transmitting wires 211, 212 and 213 which are connected to the sensor elements. By way of example, this invention describes a traffic sensor capable of monitoring four lanes of traffic simultaneously. More or less lanes for monitoring traffic is attainable with component revisions. Lane #1 transmitting signal wire would be typically embedded in groove 207 connected to lane #1 sensor element. Lane #2 embedded in groove 204 connected to lane #2 sensor element. lane #3 embedded in groove 205 connected to lane #3 sensor element. Lane #4 embedded in groove 206 connected to lane #4 sensor element.

In order to prevent the transmitting signal wires from becoming sensor elements (which incidentally would totally invalidate the concept of only receiving electric signals from vehicles that activate the sensor elements in groove 203), a procedure of using an adhesive 208, 209 and 210 to securely bond the transmitting signal wires in grooves 204, 205, 206 and 207 is employed. The adhesive is a cyanoacrylate formulated to bond PVC coated insulated wires to elastomeric materials, commonly called "super glues". The adhesive attached transmitting signal wires will now move in unison with the movement of the conductive elastomeric material and associated grooves 204, 205, 206 and the off-the-roadway section of 207. This results in no having an air gap change when the vehicle tire traverses the transmitting signal wires, hence no electric signal generation. Field tests with a wide assortment of vehicles in high and low speed conditions revealed that very low level signals (100 mv) were present on the transmitting signal wires from large heavy trucks operating at speeds exceeding 55 MPH. There were no signals from all other vehicles in this study. A further analysis revealed this low level signal was due to a piezoelectric effect and not the residual charge effect. Small light vehicles (cars) generate about 3,000 to 4,000 mv from the sensor elements within groove 203, which is worst case. Large heavy vehicles (trucks loaded with cement) generate about 100 mv from the transmitting signal wires in grooves 204, 205 and 206, which is worst case. The analyzing equipment threshold adjustment can easily discriminate between valid signals and non-valid signals with these significant proportionality differences.

Signals being generated by heavy trucks when they traverse the glued in transmitting wires are significantly reduced when the transmitting wire dielectric is changed from polyvinylchloride (PVC) to a rubber dielectric, the undesirable signals were reduced by 300%. Multi-lane axle sensor will now use stranded tinned copper wire with a cotton separator wrapping and rubber insulation. Specifically, this wire is manufactured by Belden Wire and Cable Company and their part number is 8890. This allows head room (a margin to take care of manufacturing tolerances) to spare.

The overall length of sensor 200 is dependent on the number of lanes to be monitored, each lane typically having a width of ten, eleven or twelve 12 feet. Ten feet is added for the roadside shoulder where the analyzing equipment is located and two feet is added for the far side shoulder for the tie-down bracket. A four-lane sensor 200 with 12 feet lanes would be 60 feet in length. It will be recognized the overall length of sensor 200 will be determined by the number of lanes being monitored.

The exterior profile of sensor 200 has been optimized to allow the signal output of each sensor element in groove 203 to have approximately the same signal amplitude output independent of the direction of vehicle travel with respect to the fixed location of sensor 200. A two-lane sensor could be utilized to monitor traffic in two opposite directions simultaneously or two lanes in the same direction.

In the analyzing equipment, electronic circuitry was added to develop two unique electronic signals codes, one designated as "heavy", the other designated as "normal". In certain traffic conditions, it is possible to have two normal vehicles (cars) traveling close together (tail-gating). Having a "normal" code present, the application software could make the correct decision that it was not a four-axle truck but most likely two cars spaced closely together. Another example would be a heavy two-axle truck. With a "heavy" signal code present the software application program could accurately identify this vehicle as a two-axle truck as opposed to a two-axle car. These features are possible because the sensor element signal output is nearly proportional to the weight of the vehicle. Field experience viewing thousands of vehicles of different types revealed that the sensor element signal output ranged from 3,100 mv to 78,000 mv. With this extensive range, it will be possible to generate a large number of special codes for defining a greater number of different weight vehicles.

An object of this invention is to demonstrate how the three basic components of the portable traffic roadway sensor can be configured to assemble a permanent roadway sensor. The only application difference between a portable roadway sensor and a permanent roadway sensor is the portable sensor is transportable from one location to another and permanent sensors are securely bonded into either asphalt or concrete roadways within a small narrow slot one inch deep. The sensor is then surrounded with either an epoxy, polyurethane or an acrylic grout which when cured bonds the sensor to the roadway. A problem with existing permanent sensors is roadways are eventually resurfaced. This resurfacing involves placing three inches of asphalt on top of an existing sensor which prevents the sensor's ability to recognize tire pressures from the traveling vehicles. This invention corrects this problem by manufacturing a permanent sensor that is sensitive enough to detect tire pressures with three inches of resurfaced asphalt.

Prior art permanent sensors operate on the piezoelectric effect principle using either KYNAR or ceramic as their sensing element. Typical signal outputs without resurfacing range between 100 mv to 250 mv and zero when resurfaced with asphalt. The residual charge-effect principle used in this invention uses a flat Teflon™ coated cable with seven to ten (more or less) conductors as its sensing element and will produce 1,000 mv to 3,000 mv signal output with three inches of asphalt directly on top of the sensor.

Figure 3A:
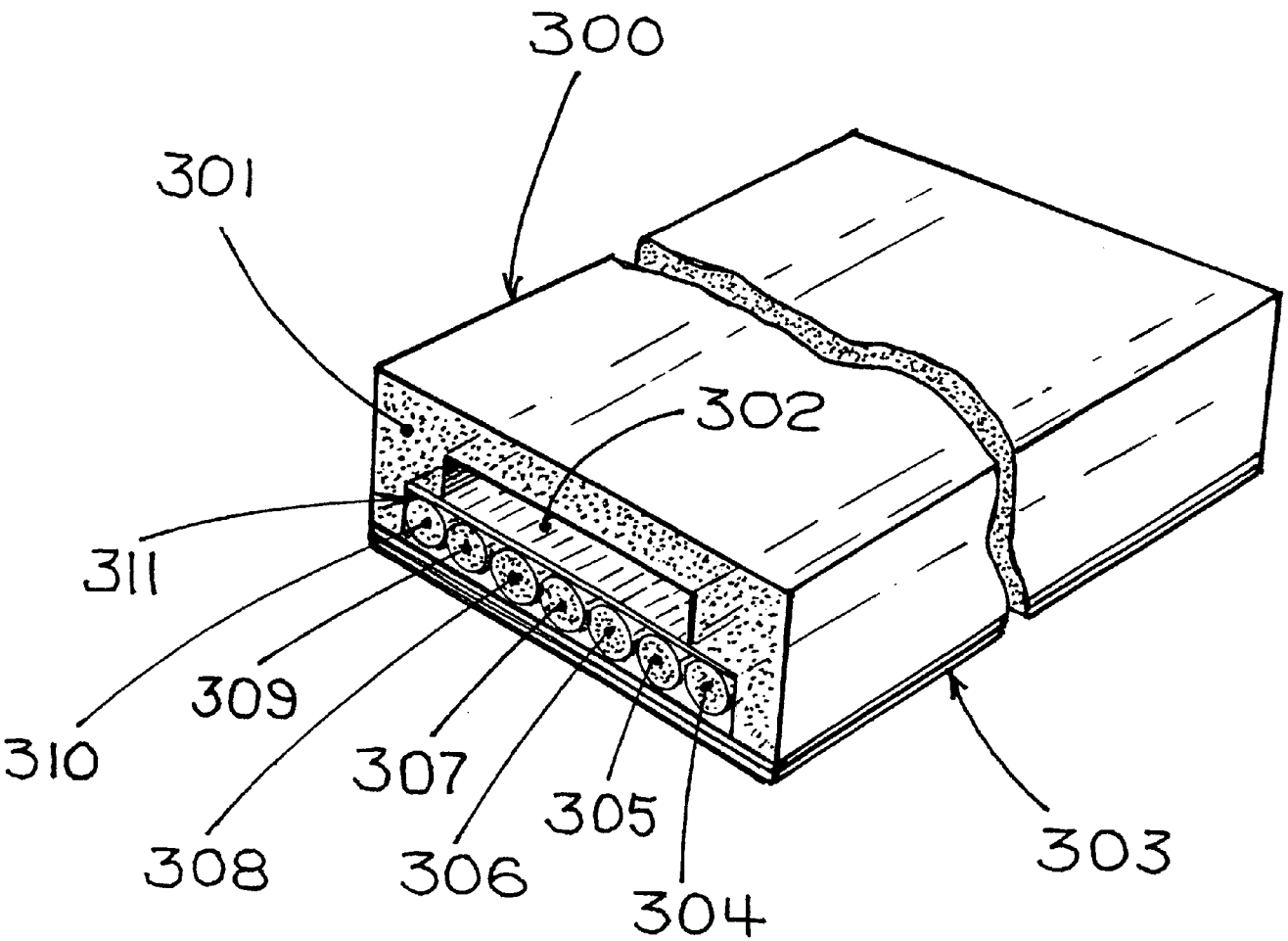
FIG. 3A illustrates a permanent sensor for monitoring a single lane of traffic.
Figure 3B:
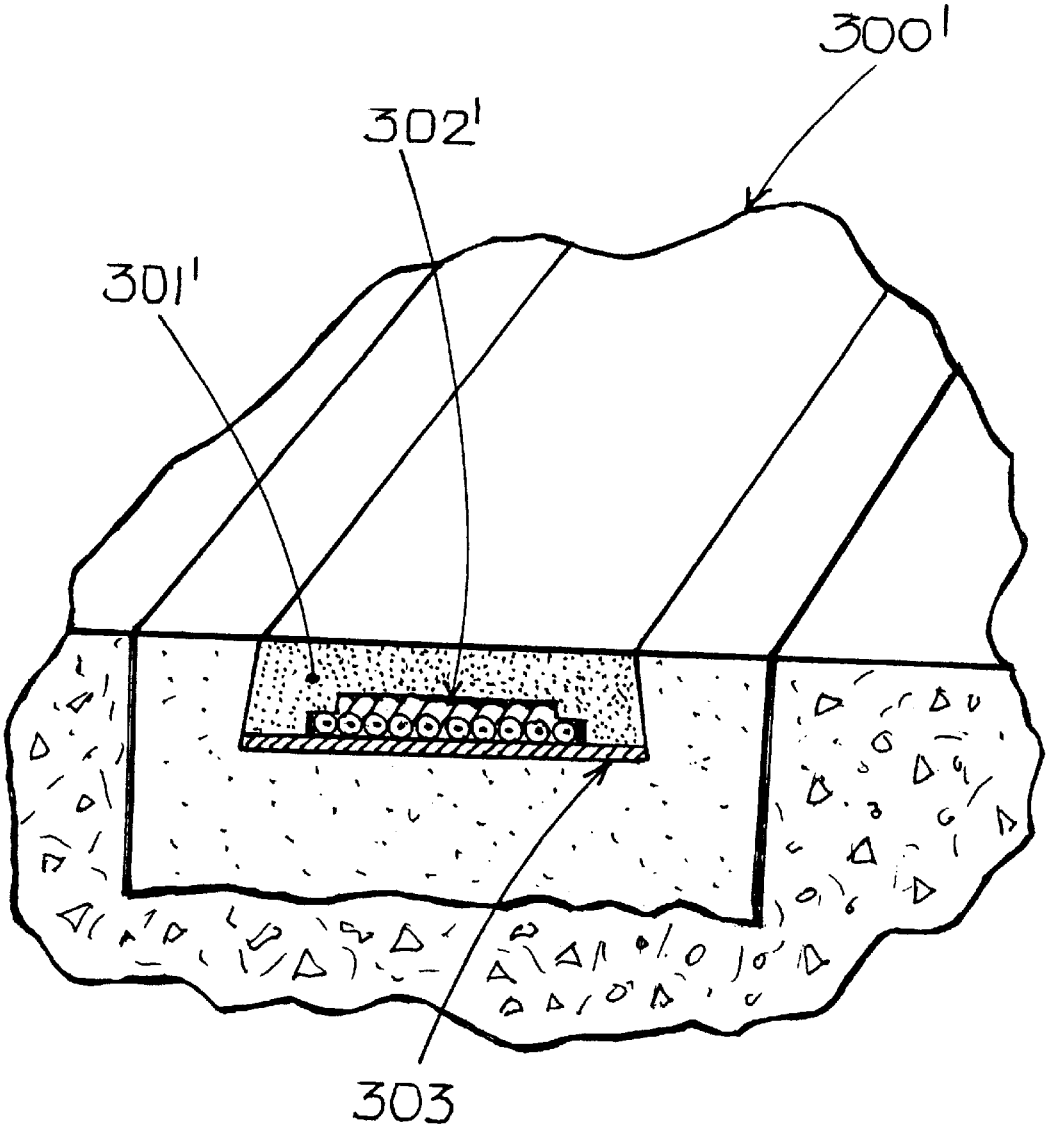
FIG. 3B illustrates an installed modification with a ten-conductor multiribbon conductor.
Figure 4:
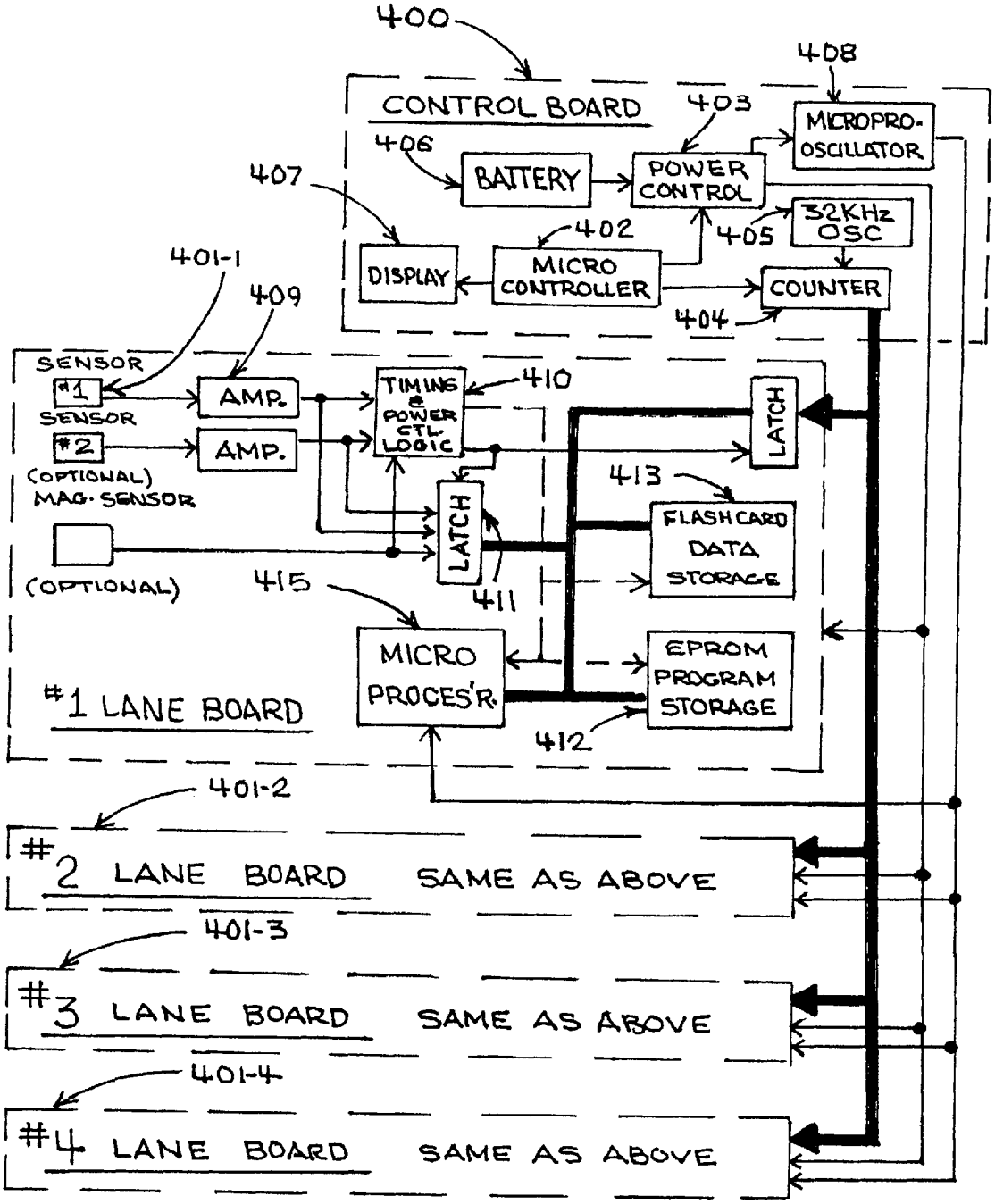
FIG. 4 is a block diagram of a data recorder.

Permanent in-pavement sensors for monitoring a single lane of traffic is shown in FIGS. 3A and 3B. The sensor 300 includes an elongated housing 301 which is formed of, for example, a conductive elastomeric material and contains an elongated cavity 311 which is adapted for a mating piece of adhesive tape and sensing elements 304–310. Cavity 311 is open during the manufacturing process to allow for the installation of sensor elements 304–310. The housing 301 is formed of a conductive elastomeric material and is configured to be placed in a cut slot in the roadway along with sensor supports (not shown) spaced so the sensor will follow the undulations of the top of the roadway surface. The housing protects the internal wiring of the sensor from its environment and also, owing to its conductive property, acts as a movable electrode in concert with other components to generate an electric signal when struck by the tire of a vehicle traversing the sensor.

Housing 301 contains a flat Teflon™-coated ribbon cable with about seven to about ten conductors 304–310. It has been found that one side of the Teflon™-coated ribbon cable is significantly more effective in generating signals, and this is determined by testing. The most effective side is oriented up in the assembly. Cavity 311 is shaped to support conductors 304 and 310. This support allow an air gap 302 to be formed between the sensor dielectric (first dielectric) and the conductive elastomeric material (second electrode). These parallel seven conductors are electrically bonded together with solder and subsequently connected to the center conductor of a coax cable (RG58U). The shield of the coax cable is electrically connected to the elastomeric material with a short piece of conductive adhesive copper tape and a solder connection is made between the copper tape and the coax shield wire. The cavity and air gap 302 is sealed to exclude moisture and water. Field tests have revealed the output signal of a single Teflon™-coated wire compared to a flat ribbon cable with seven conductors tied in parallel produces approximately six times more signal output when all peripheral conditions are the same.

As in the aforementioned, when the weighted tire of a vehicle traverses sensor 300 and makes contact on the top surface of the elastomeric material 301, the air gap 302 becomes distorted by the collapse of the conductive elastomeric material (second electrode) causing the residual charge within the sensor elements (first electrode/first dielectric) to change resulting in the generation of an electric signal on the sensor's first electrode (conductor).

The datalogger is composed of a main control board 400 and one lane board 401-1, 401-2, 401-3, 401-4 for each traffic lane being monitored. A low power microcontroller 402 on the control board 400 monitors the connection of sensors to the unit. When it is detected that all the sensor connections are made, the micro 402 enables the power control circuitry 403 to supply power to the lane boards and starts the microprocessor oscillator, which is distributed to each lane board 401-1, 401-2 . . . 401-N. the time counter 404 is reset and starts counting, from zero, in response to a temperature compensated 32 kHz oscillator 405. The control microcontroller monitors the battery 406 voltage and, if the batteries are getting low, will indicate a warning message on the LCD display 407 for several seconds before continuing. From this point on, the Control microcontroller's purpose is to constantly monitor and report status of each lane board via the display until the sensors are again disconnected from the datalogger unit.

Figure 5:
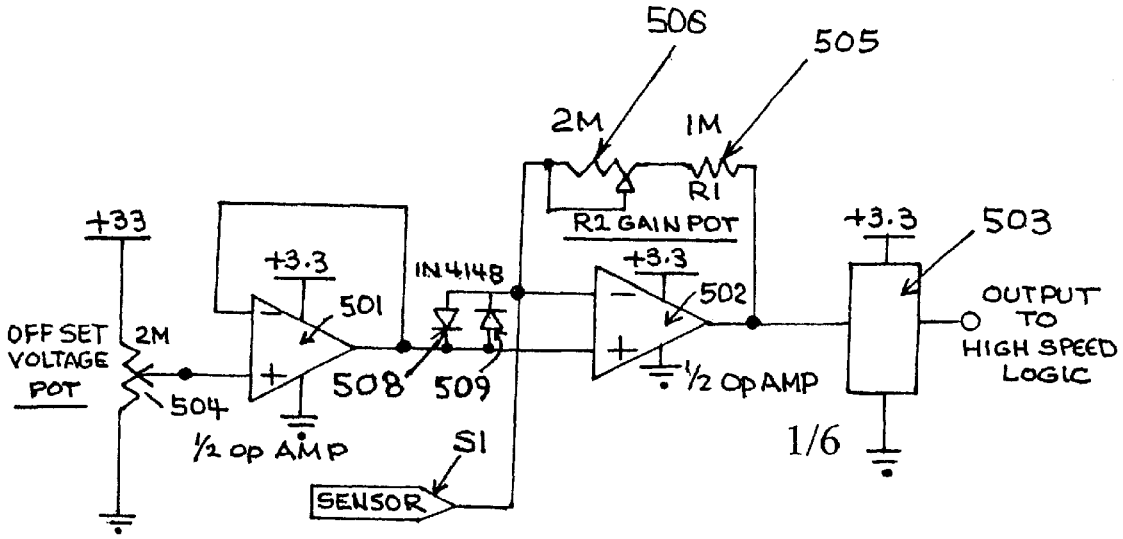
FIG. 5 illustrates a circuit diagram of a residual charge-effect amplifier.

Each lane board receives input from one, or more, sensors. The weak sensor signal is amplified in residual charge-effect sensor amplifier 408 (FIG. 5) and then monitored by the timing and power control logic 410. When an input signal is detected on any sensor input, the current value of the time counter (from the control board) is latched 411, as well as the state of all the inputs. The logic then enables power to the EPROM program storage 412, the flash card data storage 413 and wakes up the microprocessor 415. The microprocessor reads the latched data, saves the data to the flash card 413 and shuts down the flash card 413, the EPROM 412 and itself to wait for the next event.

Thus, unlike most vehicle data records that store data in "bins", the data recorder stores each "axle event" in time to a resolution of 100 $\mu$s. When the survey is complete, the flash card memory device is placed into a docking station (not shown) which is connected to a desktop computer for analysis by a software application program. This software program is designed to produce the results of the survey in the desired customer format. There are significant advantages of having the rear axle data available at the desktop level.

The residual charge-effect sensor amplifier (shown in FIG. 5) has two functions: (1) to convert an imperfect analog voltage signal varying in amplitude from approximately 2.5 volts to 80 volts and in time from 5 msec to 20 msec to a clean digital pulse with a fast rise time. The digital pulse and its fast rise time is required in order to be compatible with high-speed digital logic within the datalogger processing system; and (2) to convert the analog voltage signal to a pure current signal of at least one micro-amp. The elimination of the analog voltage signals are required to abrogate capacitor caused "crosstalk" between the signal transmitting wires within the cable connected between the multilane sensor assembly and the datalogger.

The residual charge-effect sensor amplifier circuit includes two operational amplifiers 501, 502 and one CMOS Schmitt Trigger device 503. With the sensor S1 inactive, the offset voltage pot 504 is set to about positive 2.6 volts at the output of the gain amplifier 502. This voltage level puts it above the threshold switching level of the connected Schmitt Trigger 503. It's output will then be low (gnd). When a vehicle tire makes contact with the sensor element S1, a current of about one micro-amp (or more) is generated, the output of the gain amplifier 502 will swing negative approximately 2.6 volts above ground. This will be determined by the value of the feedback resistors 505, 506, e.g., with a resistor value of 2 meg the gain of this amplifier will be about 2,000,000. This negative swing will cause the Schmitt Trigger 503 output to go to a positive 3.3 volts. As the vehicle tire leaves the sensor, the analog current from the sensor goes negative and the output from the gain amplifier 502 will go positive returning to the present offset voltage setting of 2.6 volts.

The output of the Schmitt Trigger 503 will swing negative completing the digital pulse. The Schmitt Trigger 503 plays an important role in cleaning up the ragged edges of the current pulse being generated by the sensor element. The design and selection of the Schmitt Trigger 503 takes full advantage of its input hysteresis characteristics resulting in a clean digital pulse of varying widths. The two diodes 508, 509 connected between the two input pins of the gain operational amplifier 502 serve to prevent the gain amplifier 502 from going into saturation and preventing output signal distortions. The offset pot 504 and the gain pot 506 can be replaced with fixed resistors after field testing. Vehicle speeds of between 0.5 MPH–85 MPH and weights of a general cross-section of cars and trucks can be analyzed in order to select the right values to insure 100% accurate readings from the sensor element to the Datalogger via the residual charge-effect sensor amplifier.

The datalogger is composed of a main control board 400 and one lane board 401-1, 401-2, 401-3, 401-4 for each traffic lane being monitored. A low power microcontroller 402 on the control board 400 monitors the connection of sensors to the unit. When it is detected that all the sensor connections are made, the micro 402 enables the power control circuitry 403 to supply power to the lane boards and starts the microprocessor oscillator, which is distributed to each lane board 401-1, 401-2 . . . 401-N. the time counter 404 is reset and starts counting, from zero, in response to a temperature compensated 32 kHz oscillator 405. The control microcontroller monitors the battery 406 voltage and, if the batteries are getting low, will indicate a warning message on the LCD display 407 for several seconds before continuing. From this point on, the Control microcontroller's purpose is to constantly monitor and report status of each lane board via the display until the sensors are again disconnected from the datalogger unit.

Each lane board receives input from one, or more, sensors. The weak sensor signal is amplified in residual charge-effect sensor amplifier 408 (FIG. 5) and then monitored by the timing and power control logic 410. When an input signal is detected on any sensor input, the current value of the time counter (from the control board) is latched 411, as well as the state of all the inputs. The logic then enables power to the EPROM program storage 412, the flash card data storage 413 and wakes up the microprocessor 415. The microprocessor reads the latched data, saves the data to the flash card 413 and shuts down the flash card 413, the EPROM 412 and itself to wait for the next event.

Thus, unlike most vehicle data records that store data in "bins", the data recorder stores each "axle event" in time to a resolution of 100 $\mu$s. When the survey is complete, the flash card memory device is placed into a docking station (not shown) which is connected to a desktop computer for analysis by a software application program. This software program is designed to produce the results of the survey in the desired customer format. There are significant advantages of having the rear axle data available at the desktop level.

While the invention has been described in relation to preferred embodiments of the invention, it will be appreciated that other embodiments, adaptations and modifications of the invention will be apparent to those skilled in the art.

What is claimed is:

1. In a vehicular roadway sensor comprising a conductive elastomeric housing having a base and a cavity surface in said base, a sensor wire groove in said cavity surface, said sensor wire groove comprised of an airgap portion and a sensing wire portion for receiving and maintaining one or more insulated sensing wires in a fixed relation to establish a residual charge relationship with said conductive elastomeric housing so that when said fixed relationship is changed by the wheels of a vehicle on said housing a signal voltage is induced in said sensing wire portion, and one or more insulated signal-carrying conductors connected to said one or more sensor wires, respectively, the improvement comprising, said cavity surface having one or more signal wire grooves therein and said one or more insulated signal conductors being adhesively secured in said one or more signal wire grooves, respectively, so that vehicular traffic traversing said conductive elastomeric housing does not induce significant signals in said one or more insulated signal-carrying conductors.

2. A multilane vehicular sensor comprising, for each lane, an impact sensing element comprising first unpolarized elongated dielectric, a first elongated conductive member, a second unpolarized elongated dielectric adjacent said first dielectric and a second conductive member adjacent said second dielectric, each said impact sensing element being characterized in that each has a length approximating the width of a lane and in that at least one of said dielectrics has a naturally occurring first residual charge adapted to gravitate toward an interface, said interface being disposed between a surface of one of the conductive members and said first dielectric having the naturally occurring first residual charge to thereby cause an interfacial polarization and a uniform static electric field to be generated between the conductive members, at least one of said conductive members being disposed for movement in said uniform static electric field to thereby cause a disturbance of said uniform static electric field and a signal pulse to be generated in response to movement of said at least one of said conductive members and disturbance of said uniform static electric field, and said impact sensing element having an insulated signal-carrying wire connected to the other one of said conductive members, at least one of said conductive members disposed for movement in said uniform static electric field being a conductive elastomeric extrusion having one or more passages for fixedly receiving each insulated signal-carrying wire, respectively such that a vehicle traversing said signal-carrying wire does not induce significant signals in said insulated signal-carrying wire.

3. The multilane roadway sensor defined in claim 2 wherein each insulated signal-carrying wire is adhesively retained in its respective passage.

4. The multilane roadway sensor defined in claim 3 wherein each insulated signal-carrying wire is comprised of a stranded tinned wire having a cotton separator wrapping and rubber insulation.

* * * * *